United States Patent [19]

Leafdale

[11] 4,196,827

[45] Apr. 8, 1980

[54] PORTABLE MACHINE FOR TRANSPORTING HEATED ASPHALT PRODUCTS FOR USE IN REPAIRING ASPHALT PAVEMENT

[76] Inventor: Arthur C. Leafdale, 623 Pinon Pl., Prescott, Ariz. 86301

[21] Appl. No.: 910,855

[22] Filed: Jun. 21, 1978

[51] Int. Cl.[2] ..... B67D 5/62

[52] U.S. Cl. ..... 222/146 H; 280/5 F; 222/192

[58] Field of Search ..... 222/146 R, 146 H, 146 HS, 222/146 HE, 192, 626, 627; 280/5 R, 5 F, 5 G, 5 E; 220/1 V, DIG. 24; 404/111, 108, 110

[56] References Cited

U.S. PATENT DOCUMENTS

| | | | |
|---|---|---|---|
| 1,376,852 | 5/1921 | Andresen | 404/111 X |
| 1,400,345 | 12/1921 | Brile | 280/5 F |
| 2,119,742 | 6/1938 | Gill | 280/5 F |
| 2,270,726 | 1/1942 | Elze et al. | 222/146 R |
| 3,396,644 | 8/1968 | Banks | 404/108 X |
| 3,622,748 | 11/1971 | Sellers | 222/146 HE |
| 3,907,162 | 9/1975 | Maxfield | 222/146 H |

*Primary Examiner*—Allen N. Knowles
*Attorney, Agent, or Firm*—William D. Stokes

[57] ABSTRACT

A portable machine for transporting heated asphalt products for use in repairing asphalt pavement. The machine includes a hopper for containing premixed asphalt and aggregate and a reservoir positioned below and contiguous with the hopper for containing a liquid asphalt tack material. A source of heat is disposed in the liquid asphalt tank for heating the liquid asphalt which, in turn, heats the premixed asphalt and aggregate in the hopper. The machine also includes a hydraulic power plant for operating a screw conveyor in the hopper, a pump communicating with the liquid asphalt tank, and for providing hydraulic power to the various tools employed in preparing and finishing pavement repairs.

8 Claims, 4 Drawing Figures

PORTABLE MACHINE FOR TRANSPORTING HEATED ASPHALT PRODUCTS FOR USE IN REPAIRING ASPHALT PAVEMENT

BACKGROUND OF THE INVENTION

Heretofore, the repair of chuck holes, ravels, trench openings, excavations, bell holes, and the like, in asphalt pavements required the use of at least three vehicles. One vehicle would include an air compressor for actuating the various pneumatic tools employed for dressing the hole or cavity to be filled. Another vehicle would include a heated reservoir containing a liquid asphalt tack material which would be sprayed into the dressed cavity, and a third vehicle, usually a dump truck, would then deliver a hot premixed asphalt and aggregate to the cavity; whereupon the asphalt would be manually raked, levelled and compacted to complete the repair.

The above-noted conventional method of repairing asphalt pavement is obviously expensive not only in material but also in labor.

To overcome the disadvantages experienced in the conventional method of repairing asphalt pavement, the machine of the present invention has been devised to incorporate all the phases of complete pavement repair in one mobile unit. The machine of the present invention is adapted to be mounted on a truck chassis, and comprises, essentially, a hopper for containing premixed asphalt and aggregate, and a reservoir, having a heat source, positioned below and contiguous with the hopper, the reservoir containing a liquid asphalt tack material. By the construction and arrangement of the hopper and heated reservoir, the respective asphalt products contained therein are heated by one source of heat. The machine also includes a hydraulic power plant for operating a screw conveyor in the hopper, a pump for supplying liquid asphalt to a sprayer, and for providing hydraulic power to hammers, tampers and rollers employed in the preparation and finishing of the pavement repairs.

DESCRIPTION OF THE PREFERRED EMBODIMENT

Figure 1:
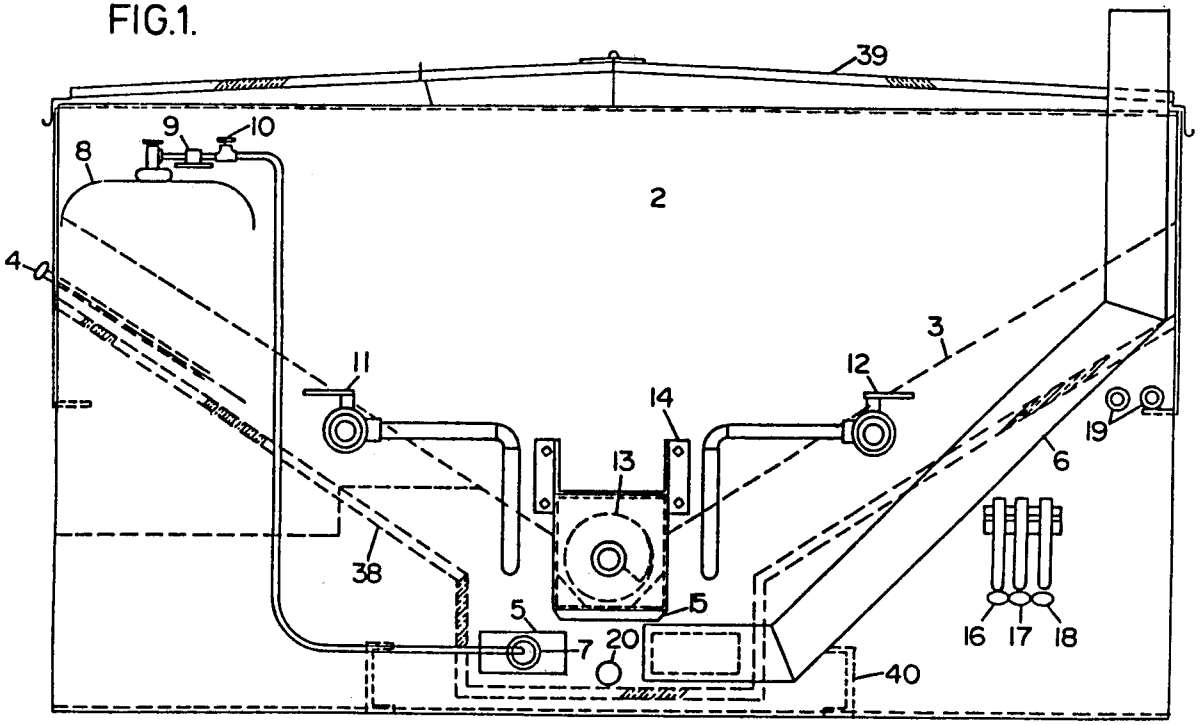
FIG. 1 is a rear elevational view of the machine of the present invention.
Figure 3:
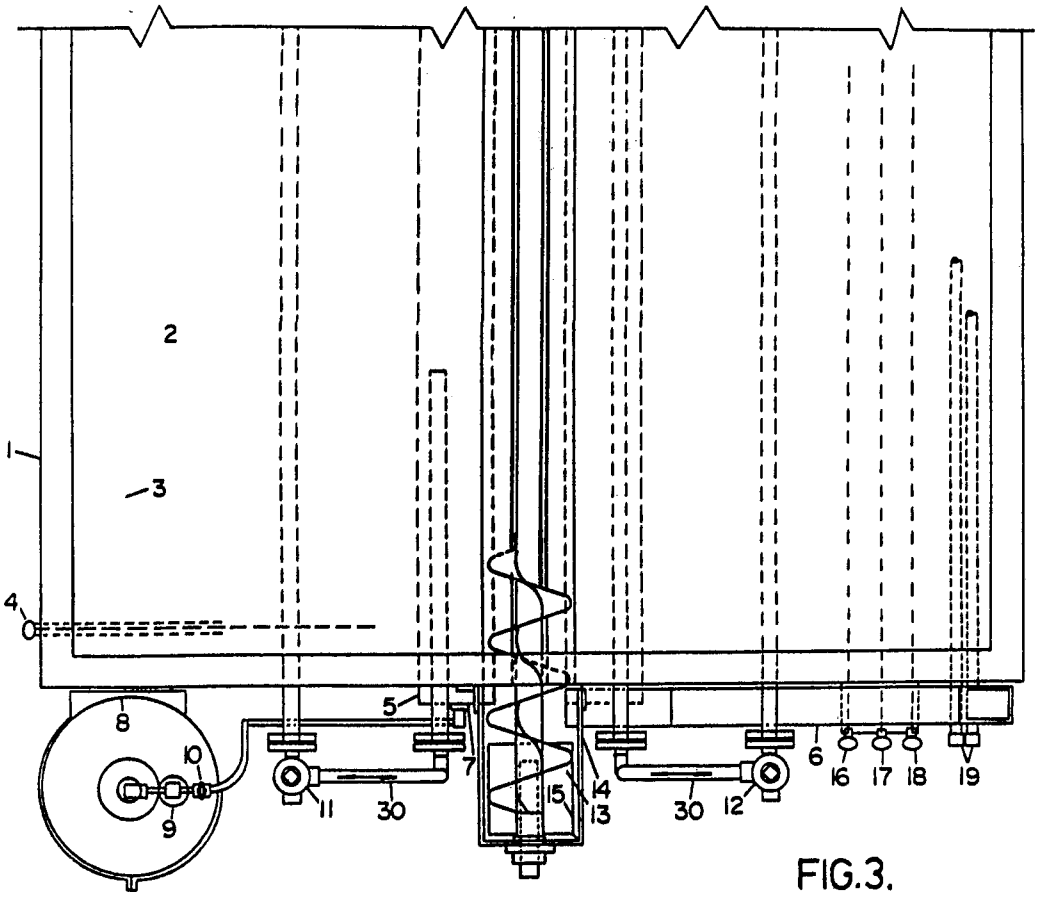
FIG. 3 is a fragmentary top plan view of the rear section of the machine.

Referring to the drawings, and more particularly to FIGS. 1 and 3 thereof, the machine of the present invention comprises a rectangular body assembly 1 adapted to be mounted on the chassis of a truck, not shown. The body assembly includes a hopper 2 adapted to contain premixed asphalt and aggregate, and a tank or reservoir 3 adapted to contain a liquid asphalt tack material, the level of which being ascertained by the use of a dip stick 4. The bottom of the tank 3 has a conduit or duct 5 providing a retort heater, the duct 5 having a section extending longitudinally from the rear of the machine toward the front, and another section extending from the front of the machine to the rear which communicates with an exhaust duct 6. A burner 7 is positioned in the duct 5 and propane fuel is supplied thereto from a tank 8 having the conventional regulator 9 and valve 10, whereby the asphalt materials in hopper 2 and tank 3 are heated to 300° F. It will be noted that the tank 3 is positioned below and is contiguous with the hopper 2. By this construction and arrangement, the premix in hopper 2 will be heated by the liquid in tank 3 which is heated by the burner 7, whereby the respective asphalt products are heated by one heat source. Three-way valves 11 and 12 and associated piping communicate with the tank 3 to control the circulation of liquid into, through or out of the tank to suitable spray equipment, not shown.

A longitudinally extending screw conveyor 13 is mounted in a trough formed in the bottom of hopper 2, the end of the conveyor being journalled in a bearing bracket 14 secured to the end wall of the housing 1. An aperture 15 is provided in the discharge end of the trough to form a conveyor outlet for the premix in the hopper.

Suitable control levers 16, 17 and 18 are accessibly mounted on the rear wall of the body 1, the levers being employed for controlling the actuation of the conveyor, and associated hydraulic equipment, to be described. Also mounted on the rear wall of the body are quick-disconnect couplings 19 to which hydraulic tools are adapted to be connected, and a drain outlet 20 for the tank 3.

Figure 2:
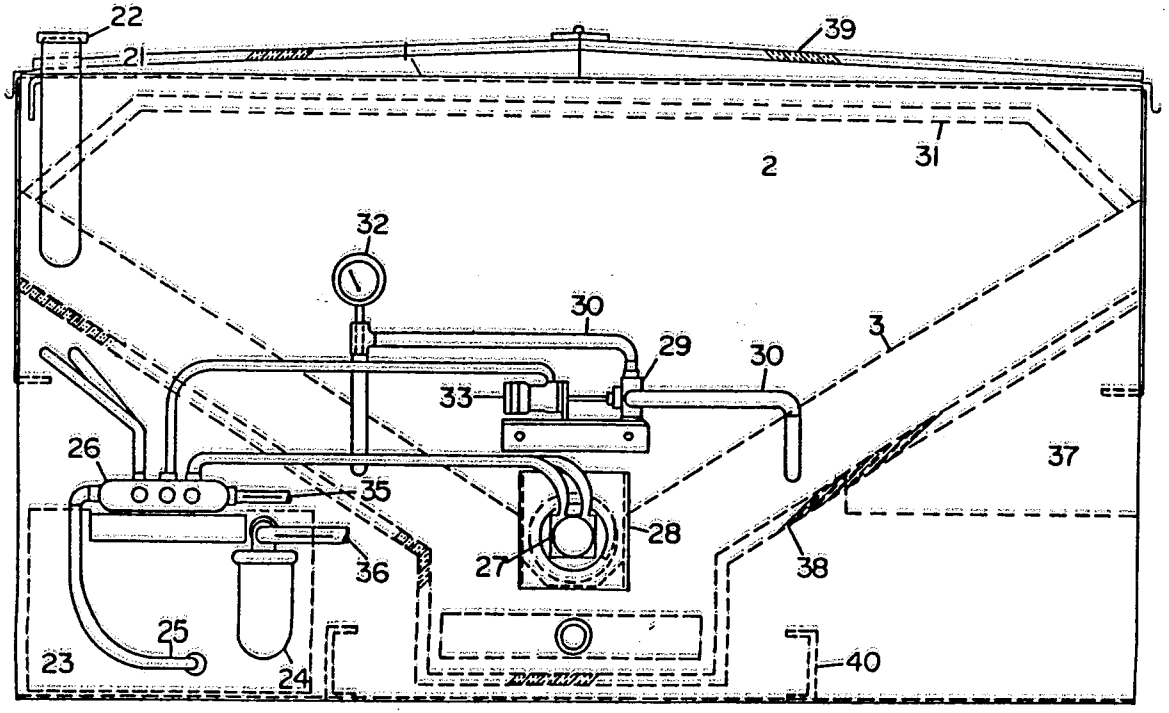
FIG. 2 is a front elevational view of the machine.
Figure 4:
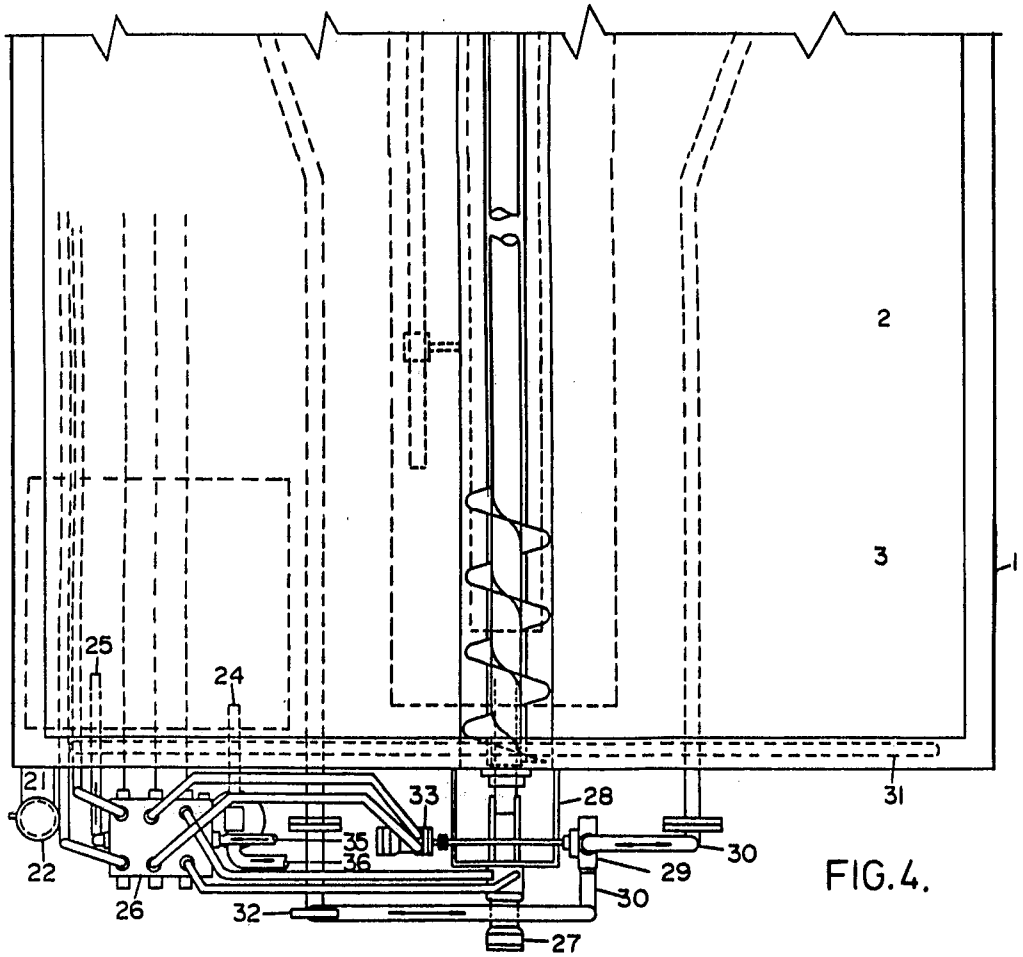
FIG. 4 is a fragmentary top plan view of the foward section of the machine.

While the above-described components of the machine of the present invention are positioned at the rear of the body 1, other components including a hydraulic power plant for operating the machine are positioned at the front of the body, as will be seen in FIGS. 2 and 4. A filler spout 21, having a relief valve 22, is mounted on the front wall of the body and communicates with the tank 3. A hydraulic fluid reservoir 23 is mounted on the bottom of the body adjacent the front wall thereof, and communicates with an oil filter 24, hydraulic oil return line 25, and hydraulic valve gang 26 which selectively controls the flow of hydraulic fluid to a hydraulic motor 27, mounted in a bracket 28, and connected to the end of the conveyor 13. A gear pump 29 is mounted on the front wall of the housing and is connected to a transfer line 30 communicating with the tank 3 which also has a cross vent line 31. The transfer line 30 includes a temperature gauge 32 for determining the temperature of the heated asphalt liquid being circulated through the line 31 to the valves 11 and 12 by the gear pump 29 which is driven by a reversible hydraulic motor 33.

An engine driven hydraulic pump, not shown, mounted on the vehicle chassis, is connected to line 35 whereby pressurized hydraulic fluid is supplied to the valve gang 26 for operating the conveyor motor 27 and reversible pump motor 33, the return of the hydraulic fluid to the pump being through line 36.

To complete the structural description of the machine of the present invention, a tool compartment 37 is provided on the side of the body beneath the tank 3, and a layer of insulation 38 is provided on the exposed surface of the bottom wall of the tank 3 to prevent the transmission of heat to the tool compartment 37 and hydraulic reservoir 23 positioned below the tank. An insulated cover 39 can be provided on the top of the hopper 2 to maintain the premix in a heated state, and the machine can be mounted on the chassis of the truck by support members 40.

In the operation of the machine of the present invention, the hopper 2 is loaded with a premixed asphalt and aggregate, and the tank 3 is filled with liquid asphalt tack material. The burner 7 is then ignited to heat the duct 5 to raise the temperature of the liquid in tank 3, heat from the tank surface, being contiguous with the bottom of the hopper 2, radiates into the asphalt in the hopper. Valves 11 and 12 and lever 17 are actuated to start motor 33 and associated pump 29, whereby the heated liquid is circulated through the tank 3 until the desired temperature is reached; whereupon the machine is transported to the job site. At the job site, suitable hydraulic tools are connected to the quick-disconnect couplers 19 and lever 18 is actuated, whereby preliminary preparation of the repairs can be quickly accomplished. Suitable spray equipment is connected to discharge valve 12 which is positioned to spray and seal tack the dressed cavity. Lever 16 is then actuated to operate the screw conveyor 13 to dispense the premix through the outlet 15 into the cavity as required. The filled cavity is then compacted with a hydraulic tamper.

After the job has been completed, the rotation of the pump 29 can be reversed to thereby scavenge the various spray hoses and piping to prevent solidification of the asphalt material therein.

From the above description, it will be readily apparent to those skilled in the art that the machine of the present invention incorporates all the phases of a complete pavement repair in one mobile unit operable by one or two men resulting in a saving of expense, energy, time and manpower.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A portable machine for transporting heated asphalt products for use in repairing asphalt pavement, comprising a body assembly adapted to be mounted on a vehicle chassis, said body assembly including a hopper adapted for dispensing premixed asphalt and aggregate, a tank positioned below and being contiguous with the bottom wall of said hopper, said tank adapted for dispensing a liquid asphalt tack material, and heater means positioned in said tank for heating said liquid, the heat therefrom radiating through the bottom wall of said hopper to thereby heat the premixed asphalt and aggregate contained thereon.

2. A portable machine for transporting heated asphalt products according to claim 1, wherein the heater means comprises a conduit positioned in the bottom of said tank, an exhaust duct connected to one end of said conduit, a burner connected to the other end of said conduit, and a source of fuel connected to said burner.

3. A portable machine for transporting heated asphalt products according to claim 1, wherein a hydraulic power plant is operatively connected to said body assembly, said hydraulic power plant including a source of hydraulic pressure communicating with a reversible hydraulic motor connected to a pump, pipe means connected to said pump, and valve means connected to said pipe means for controlling the circulation of liquid into, through and out of the tank.

4. A portable machine for transporting heated asphalt products according to claim 3, wherein a conveyor is mounted in the bottom of said hopper for dispensing the premixed asphalt and aggregate therefrom, a hydraulic motor connected to the conveyor for driving said conveyor, said source of hydraulic pressure being connected to said motor for driving said motor.

5. A portable machine for transporting heated asphalt products according to claim 4, wherein a plurality of quick-disconnect couplings are accessibly mounted on the rear wall of the body to which hydraulic tools are adapted to be connected, said couplings communicating with said hydraulic power plant.

6. A portable machine for transporting heated asphalt products according to claim 5, wherein a plurality of control levers are accessibly mounted on the rear wall of the body for controlling the actuation of the conveyor, pump, and hydraulic tools.

7. A portable machine for transporting heated asphalt according to claim 1, wherein a layer of insulation is applied to the outer wall surface of said tank.

8. A portable machine for transporting heated asphalt according to claim 7, wherein a storage compartment is disposed within the body below the tank.

* * * * *